US010818223B2

(12) United States Patent
Yu

(10) Patent No.: US 10,818,223 B2
(45) Date of Patent: Oct. 27, 2020

(54) ORGANIC LIGHT EMITTING DISPLAY DEVICE AND METHOD OF DRIVING SAME

(71) Applicant: LG DISPLAY CO., LTD., Seoul (KR)

(72) Inventor: Jaesung Yu, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 24 days.

(21) Appl. No.: 16/176,268

(22) Filed: Oct. 31, 2018

(65) Prior Publication Data

US 2019/0130826 A1 May 2, 2019

(30) Foreign Application Priority Data

Oct. 31, 2017 (KR) ..... 10-2017-0143920

(51) Int. Cl.

| | |
|---|---|
| ***G09G 3/30*** | (2006.01) |
| ***G09G 3/3225*** | (2016.01) |
| ***G09G 3/3266*** | (2016.01) |
| ***G09G 3/3233*** | (2016.01) |

(52) U.S. Cl.

CPC ..... *G09G 3/3225* (2013.01); *G09G 3/3233* (2013.01); *G09G 3/3266* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2320/0233* (2013.01); *G09G 2320/043* (2013.01); *G09G 2320/045* (2013.01)

(58) Field of Classification Search

USPC ..... 345/76, 77, 78, 204, 205, 215, 174; 330/10

See application file for complete search history.

(56) References Cited

U.S. PATENT DOCUMENTS

2005/0088227 A1* 4/2005 Sakata ..... H03K 17/063 330/10
2015/0187432 A1* 7/2015 Jinta ..... G09G 3/3233 345/77
2015/0193045 A1* 7/2015 Zhou ..... G06F 3/044 345/174
2015/0269885 A1* 9/2015 Ma ..... G09G 3/3233 345/205

(Continued)

FOREIGN PATENT DOCUMENTS

KR 20160008047 A 1/2016
KR 20160089939 A 7/2016

(Continued)

*Primary Examiner* — Thuy N Pardo
(74) *Attorney, Agent, or Firm* — Polsinelli PC

(57) ABSTRACT

An organic light emitting display device includes an organic light emitting device, a first thin film transistor which is connected in series with the organic light emitting device between a first driving source line supplying a first driving source and a second driving source line supplying a second driving source lower than the first driving source, and second and third thin film transistors which are connected in series with each other between a first node between the first thin film transistor and the organic light emitting device and a data line supplying a data signal. The number of the drive control signals supplied to respective pixels in this organic light emitting display device can be reduced, thereby preventing a bezel from being widened due to a gate drive unit embedded in a display panel.

19 Claims, 7 Drawing Sheets

(56) References Cited

U.S. PATENT DOCUMENTS

| | | | | |
|---|---|---|---|---|
| 2015/0269890 | A1* | 9/2015 | Ma | G09G 3/3291 345/215 |
| 2015/0364087 | A1* | 12/2015 | Gu | G09G 3/3233 345/78 |
| 2016/0133185 | A1* | 5/2016 | Yoon | G09G 3/3233 345/76 |
| 2018/0062105 | A1* | 3/2018 | Lius | H01L 27/3262 345/204 |

FOREIGN PATENT DOCUMENTS

| | | | |
|---|---|---|---|
| KR | 20170007574 | A | 1/2017 |
| KR | 20170036934 | A | 4/2017 |

* cited by examiner

ORGANIC LIGHT EMITTING DISPLAY DEVICE AND METHOD OF DRIVING SAME

CROSS-REFERENCE TO RELATED APPLICATION

This application claims the benefit of the Korean Patent Application No. This application claims the benefit of Korean Patent Application No. 10-2017-0143920, filed on Oct. 31, 2017, in the Korean Intellectual Property Office, the disclosure of which is incorporated herein in its entirety by reference.

BACKGROUND

Field of the Disclosure

The present disclosure relates to an active matrix organic light emitting display device having a compensation circuit, and a method of driving the same.

Description of the Background

Display devices are applied in various electronic devices such as a television (TV), a portable phone, a laptop computer, and a tablet, etc. So, much effort has been made in order to reduce a thickness, a weight, and power consumption of the display device.

Representative examples of the display device include a liquid crystal display device (LCD), a plasma display device (PDP), a field emission Display device (FED), an electroluminescence Display device (ELD), an electro-Wetting Display device (EWD), and an organic light emitting display device (OLED), etc.

Among them, the organic light emitting display device includes a plurality of organic light emitting devices corresponding to a plurality of pixels. Since the organic light emitting device is a self-emitting light emitting element, the organic light emitting display device has a faster response time, a higher light emitting efficiency, a higher brightness, a greater viewing angle, and between contrast and color reproduction ratio than the liquid crystal display device.

The organic light emitting display device can be implemented as an active matrix type in which the pixels are individually driven.

In the active matrix organic light emitting display device, each pixel generally includes an organic light emitting device, a pixel driving circuit for supplying a drive current to the organic light emitting device.

For example, the pixel driving circuit can include a switching thin film transistor for supplying a data signal corresponding to the brightness of the organic light emitting device, a storage capacitor which is charged based on the data signal, and a driving thin film transistor which generates the drive current having a magnitude corresponding to the data signal. Here, the switching thin film transistor is turned on based on a drive control signal supplied from a gate drive unit.

Meanwhile, in order to suppress the brightness difference among respective pixels, the driving thin film transistor for the plurality of pixels need to be designed to have the same electrical characteristics such as a threshold voltage, a mobility, etc. On the other hand, due to the process conditions, the operation environment, and the operation time, etc., uniformity in the electrical characteristics of the driving thin film transistors can be decreased. More specifically, threshold voltages of the driving thin film transistors can be varied differently due to the different driving stresses for the pixels, and it can increase the brightness difference among respective pixels, which results in poor display quality such as blurs, etc.

In order to resolve this problem, each pixel of the organic light emitting display device can further include a compensation circuit for preventing the brightness difference among respective pixels due to the variation in the threshold voltages of the driving thin film transistors.

For example, the compensation circuit can include a sampling thin film transistor connected with a gate electrode of the driving thin film transistor and an initialization thin film transistor for initializing the storage capacitor.

Similarly, when the respective pixels of the organic light emitting display device include the pixel driving circuit and the compensation circuit, a plurality of different drive control signals for driving the thin film transistors individually need to be supplied to the respective pixels. In the meantime, the drive control signals can have different pulse-widths, have successive falling timings or rising timings, or correspond to transistors of different conduction types.

And, the gate drive unit for supplying the drive control signal for the thin film transistor should have plurality of signal generating blocks corresponding to the different drive control signals. Therefore, as the number of the drive control signals supplied to the respective pixels increases, the structure of the gate drive unit gets more complicated.

Also, when the gate drive unit is embedded in the display panel, the width of a bezel of the display device cannot be decreased over a certain limit since the width of the area allocated to the gate drive unit increases as the structure of the gate drive unit gets complicated

SUMMARY

The present disclosure is to provide an organic light emitting display device capable of decreasing the number of drive control signals supplied to the respective pixels, and a method of driving the same.

In addition, the present disclosure are not limited to the objective mentioned in the above, and other objectives and advantages of the present disclosure can be understood based on the description in the following and more clearly understood based on the aspects of the present disclosure. In addition, it will be apparent that the advantages of the present disclosure can be realized by the means set forth in the claims and a combination thereof.

An aspect of the present disclosure provides an organic light emitting display device comprising: an organic light emitting device, a first thin film transistor which is connected in series with the organic light emitting device between a first driving source line supplying a first driving source and a second driving source line supplying a second driving source lower than the first driving source, and second and third thin film transistors which are connected in series with each other between a first node between the first thin film transistor and the organic light emitting device and a data line supplying a data signal.

The second thin film transistor is disposed between the data line and the third thin film transistor, the third thin film transistor is disposed between the second thin film transistor and the first node, and one of the second and third thin film transistors is turned on based on an ith switching scan signal (i is a natural number greater than or equal to 1 and smaller than or equal to N, where N is the number of horizontal lines) while the other is turned on based on an $(i+1)^{th}$ switching scan signal.

The organic light emitting display device can further comprise a storage capacitor which is disposed between a second node connected with a gate electrode of the first thin film transistor and a third node connected with an anode electrode of the organic light emitting device, and a fourth thin film transistor which is connected between an initialization source line supplying an initialization source and the third node. Here, the fourth thin film transistor is turned on based on the ith switching scan signal.

The organic light emitting display device can further comprise a fifth thin film transistor which is connected between a fourth node between the first thin film transistor and the first driving source line and the second node. Here, the fifth thin film transistor is turned on based on an ith sampling scan signal.

The organic light emitting display device can further comprise a sixth thin film transistor which is connected between the first driving source line and the fourth node and is turned on based on an $(i+1)^{th}$ emission signal, and a seventh thin film transistor which is connected between the first node and the third node and is turned on based on an ith emission signal.

The first and fifth thin film transistors of the first, second, third, fourth, fifth, sixth, and seventh thin film transistors can include an active layer made of an oxide semiconductor material while the rest thin film transistors include an active layer made of a polysilicon semiconductor material. Here, the thin film transistors including the active layer made of the oxide semiconductor material and the thin film transistors including the active layer made of the polysilicon semiconductor material are formed in metal oxide semiconductor (MOS) structures with different conduction types.

The other aspect of the present disclosure provides a method of driving an organic light emitting display device having organic light emitting devices corresponding to the respective pixels. The organic light emitting display device comprises a first thin film transistor which is connected in series with the organic light emitting device between a first driving source line supplying a first driving source and a second driving source line supplying a second driving source lower than the first driving source, second and third thin film transistors which are connected in series with each other between a first node between the first thin film transistor and the organic light emitting device and a data line supplying a data signal, a storage capacitor which is disposed between a second node connected with a gate electrode of the first thin film transistor and a third node connected with an anode electrode of the organic light emitting device, a fourth thin film transistor which is connected between an initialization source line supplying an initialization source and the third node, a fifth thin film transistor which is connected between a fourth node between the first thin film transistor and the first driving source line and the second node, a sixth thin film transistor which is connected between the first driving source line and the fourth node, and a seventh thin film transistor which is connected between the first node and the third node. The method of driving an organic light emitting display device comprises: supplying the initialization source to the third node during a first period by turning on the fourth thin film transistor, and supplying the first driving source to the second node by turning on the fifth and sixth thin film transistors; supplying the data signal to the first node during a second period by turning on the second and third thin film transistors; and supplying a drive current to the organic light emitting device during a third period by turning on the first, sixth, and seventh thin film transistors.

One of the second and third thin film transistors is turned on based on an ith switching scan signal (i is a natural number greater than or equal to 1 and smaller than or equal to N, where N is the number of horizontal lines) while the other is turned on based on an $(i+1)^{th}$ switching scan signal, and the fourth thin film transistor is turned on based on the ith switching scan signal.

One of the second and third thin film transistors is turned on along with the fourth thin film transistor during the first and second periods based on the ith switching scan signal, while the other is turned on during the second and third periods based on the $(i+1)^{th}$ switching scan signal.

The fifth thin film transistor is of a conduction type different from that of the fourth thin film transistor, and the fifth thin film transistor is turned on during the first and second periods based on an ith sampling scan signal.

The sixth thin film transistor is turned on during the first and third periods based on an $(i+1)^{th}$ emission signal, and the seventh thin film transistor is turned on during the third period based on an ith emission signal.

The organic light emitting display device according to an aspect of the present disclosure comprises an organic light emitting device, a first thin film transistor connected in series with the organic light emitting device, second and third thin film transistors connected between a first node, between the first thin film transistor and the organic light emitting device, and a data line supplying a data signal corresponding to a drive current of the organic light emitting device, a storage capacitor disposed between a second node, which is connected with a gate electrode of the first thin film transistor, and a third node, which is connected with an anode electrode of the organic light emitting device, and a fourth thin film transistor connected between an initialization source line supplying an initialization source and the third node.

Similarly, since the second and third thin film transistors are connected in series between the data line and the first node, the data signal can be supplied to the first node during a period when all of the second and third thin film transistors are turned on.

As a result, one of the second and third thin film transistors can be turned on based on the ith switching scan signal (i is a natural number greater than or equal to 1 and smaller than or equal to N, where N is the number of the horizontal lines) with the fourth thin film transistor, while the other can be turned on based on a next switching scan signal for the next sequential horizontal line, which has the same pulse-width as the ith switching scan signal and a falling or rising time which does not follow the ith switching scan signal, that is, the $(i+1)^{th}$ switching scan signal. As a result, the number of the drive control signals supplied to the respective pixels can be decreased since a separate drive control signal for supplying the data signal is not necessary.

And, since the number of drive control signals is decreased, complexity of the gate drive unit can be alleviated. Therefore, it is possible to prevent a width of a bezel of the display panel in a structure where the gate drive unit is embedded in the display panel from being increased due to the gate drive unit.

DETAILED DESCRIPTION

The features and advantages will be explained in detail by referring to the appended figures, such that a skilled person in the art to which the present disclosure pertains can readily practice the technical spirit of the present disclosure. Also, in the explanation on the present disclosure in the following, detailed explanations on related known technique will be omitted when it is determined that they will unnecessarily obscure the subject matter of the present disclosure. In the following, aspects of the present disclosure will be described in detail by referring to appended figures. In the figures, same reference symbols are used to refer to the same or similar components.

In the following, the organic light emitting display device according to an aspect of the present disclosure and a method of driving the same will be explained in detail by referring to the appended figures.

Figure 1:
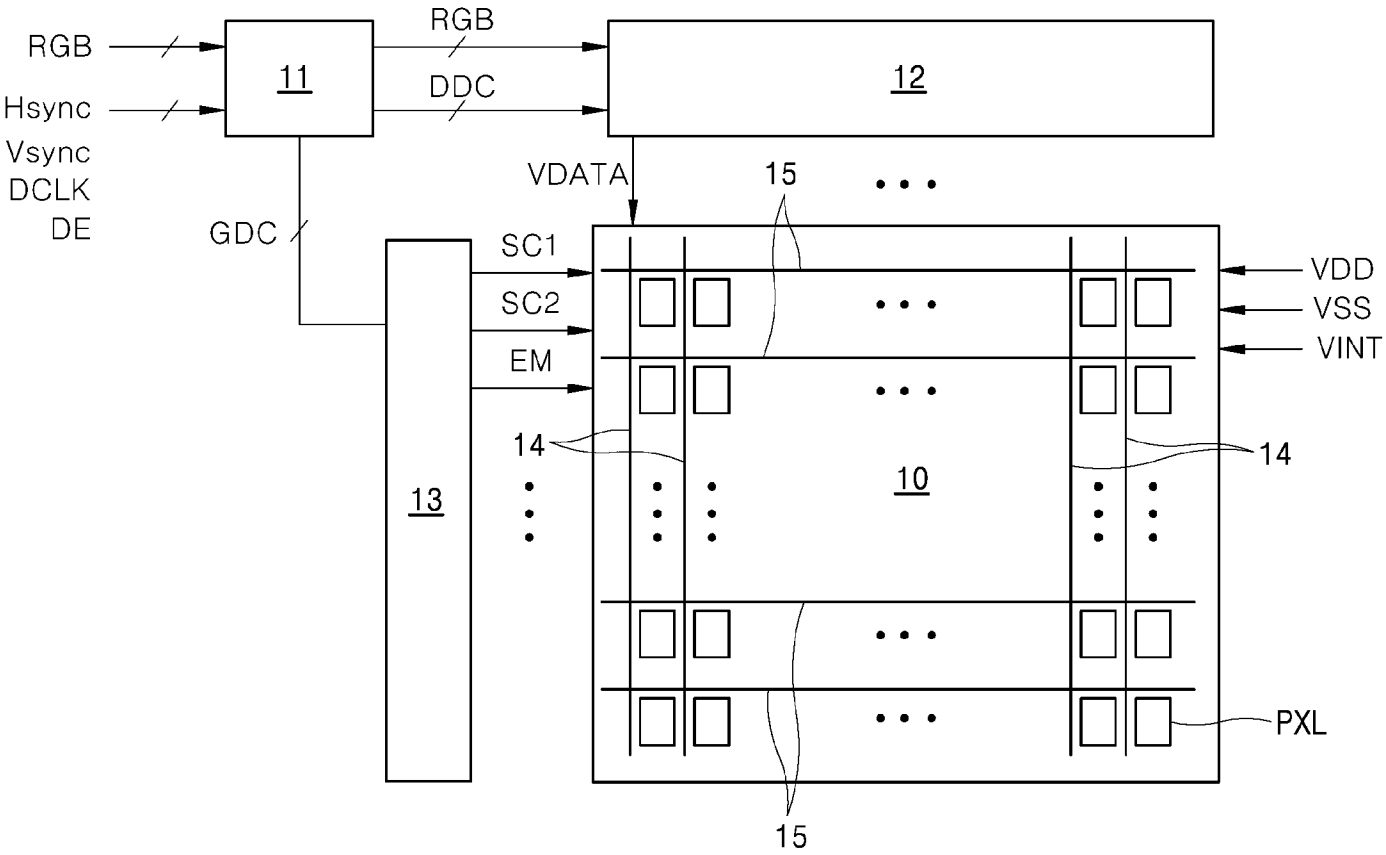
FIG. 1 is a diagram illustrating an organic light emitting display device according to an aspect of the present disclosure.
Figure 2:
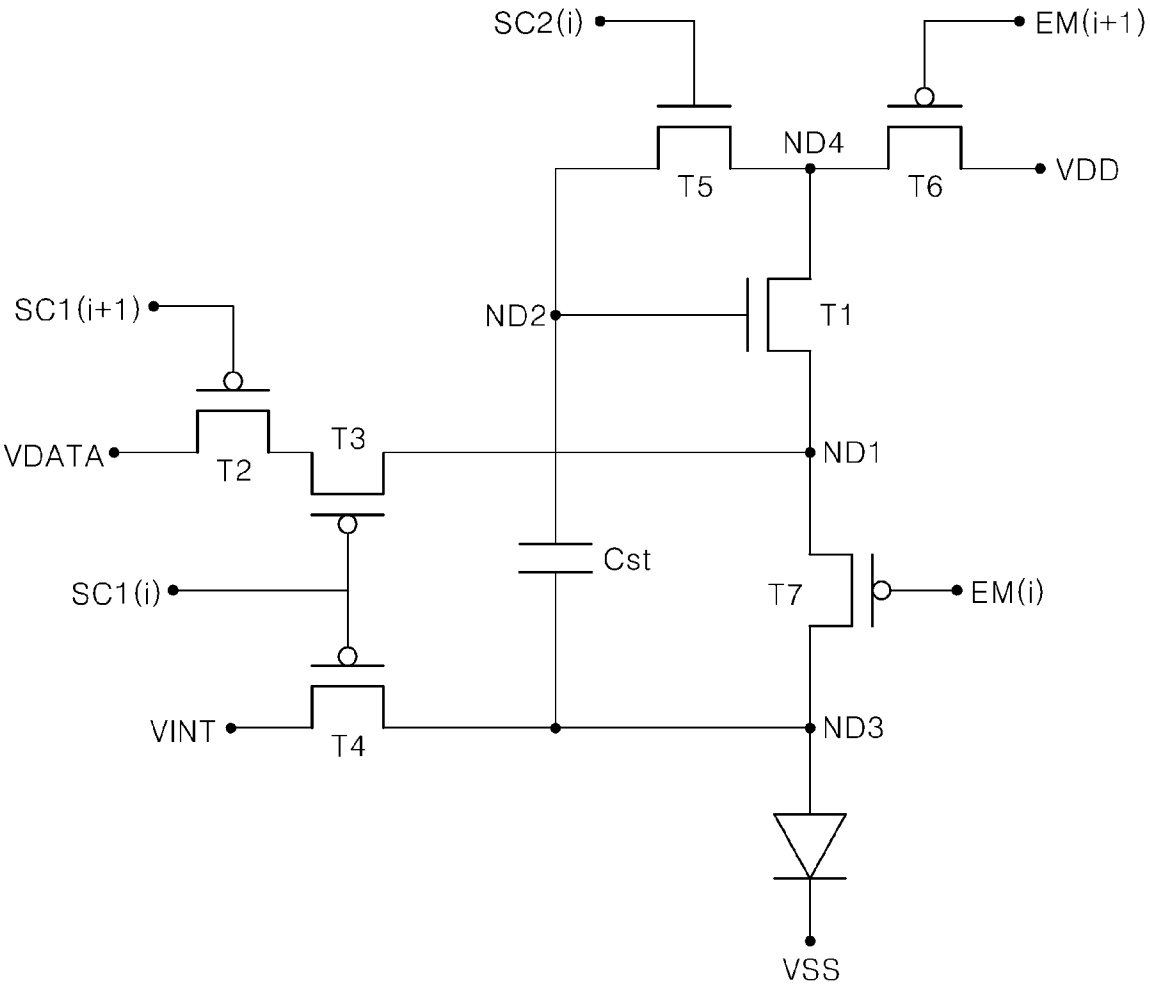
FIG. 2 is a diagram showing an equivalent circuit corresponding to one pixel in the organic light emitting display device according to an aspect of the present disclosure.
Figure 3:
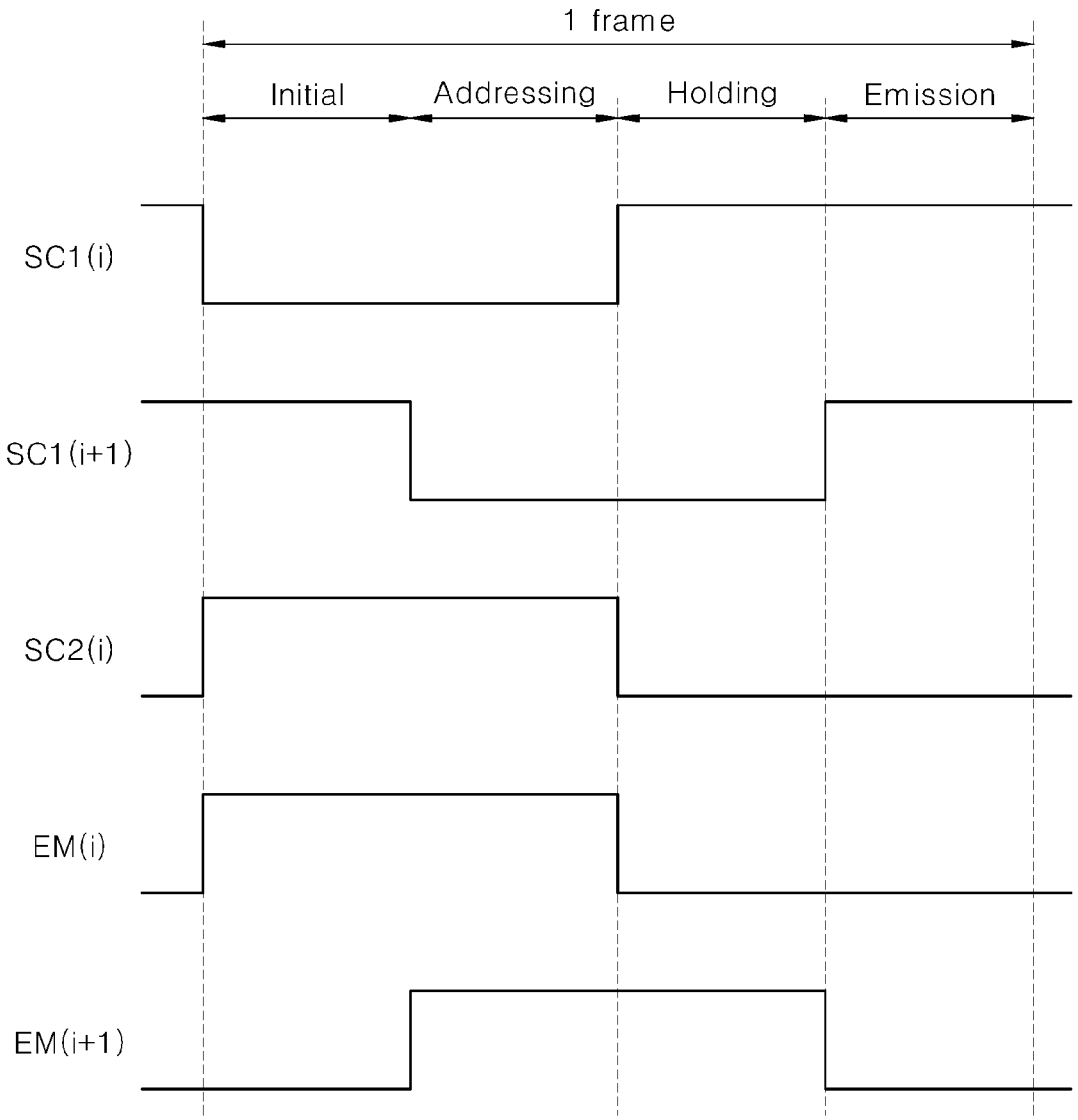
FIG. 3 shows waveforms of the drive control signals of FIG. 2.
Figure 4:
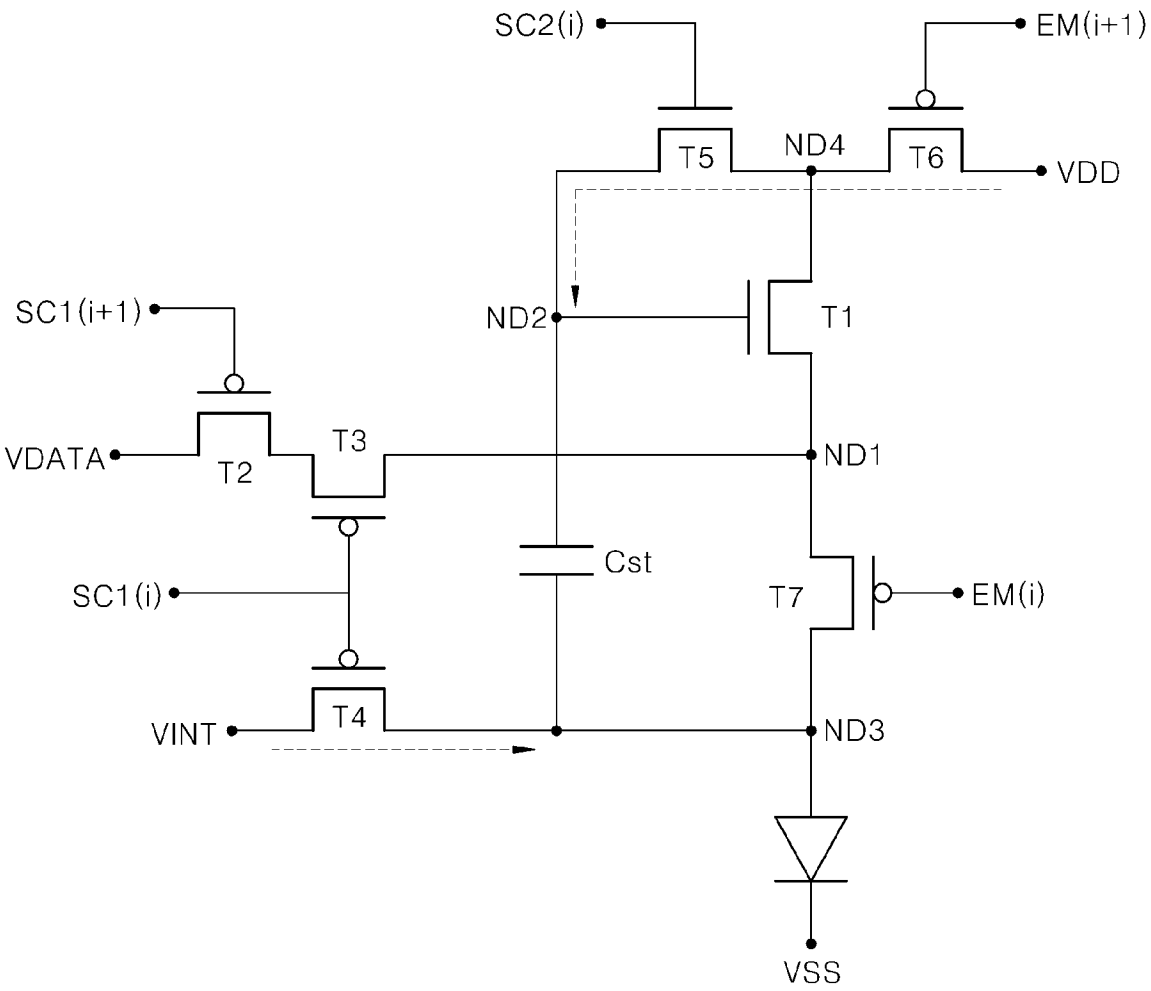
FIG. 4, FIG. 5, and FIG. 6 are diagrams showing current directions in the equivalent circuit corresponding to the pixel during an initial period, an addressing period, and an emission period in FIG. 3.
Figure 5:
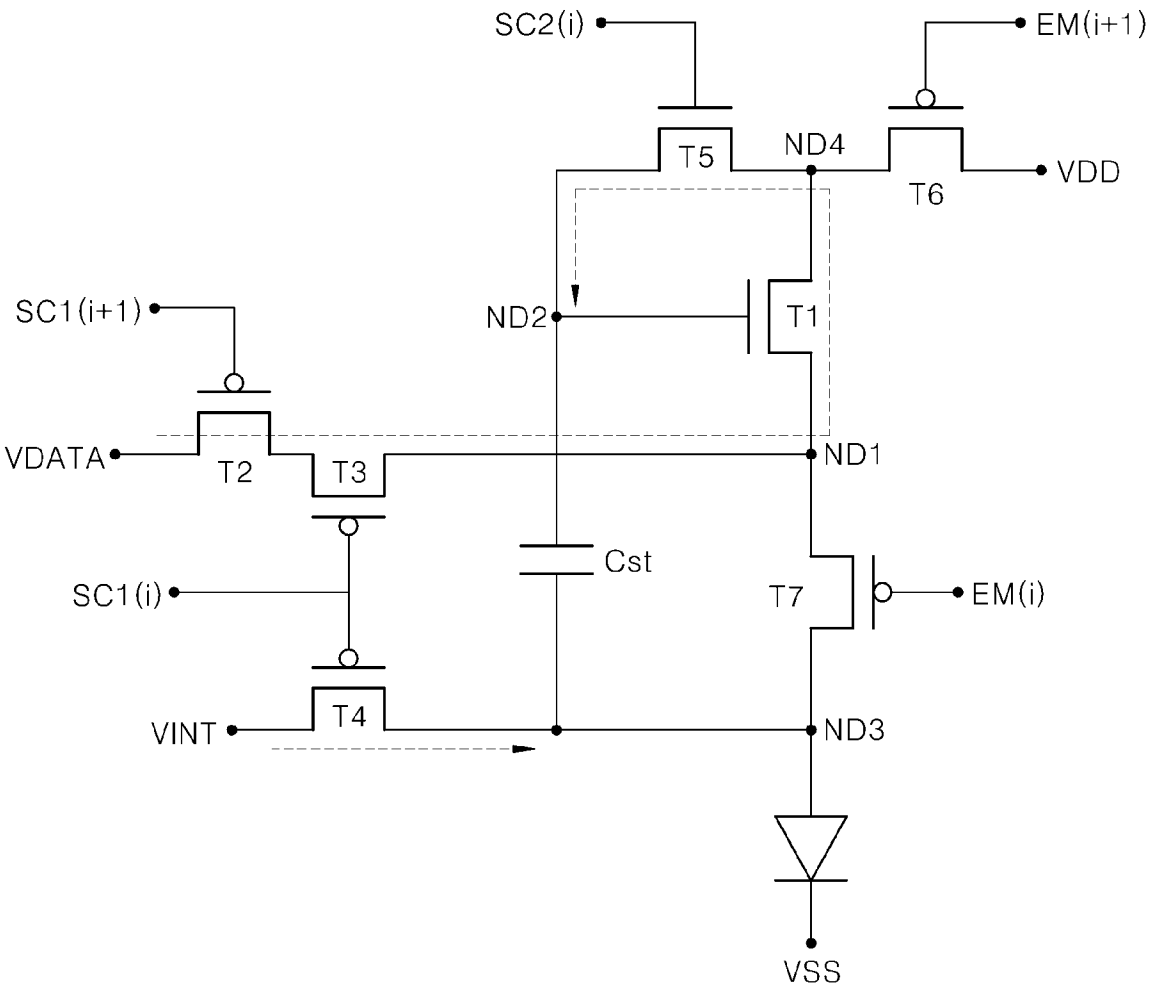
Figure 6:
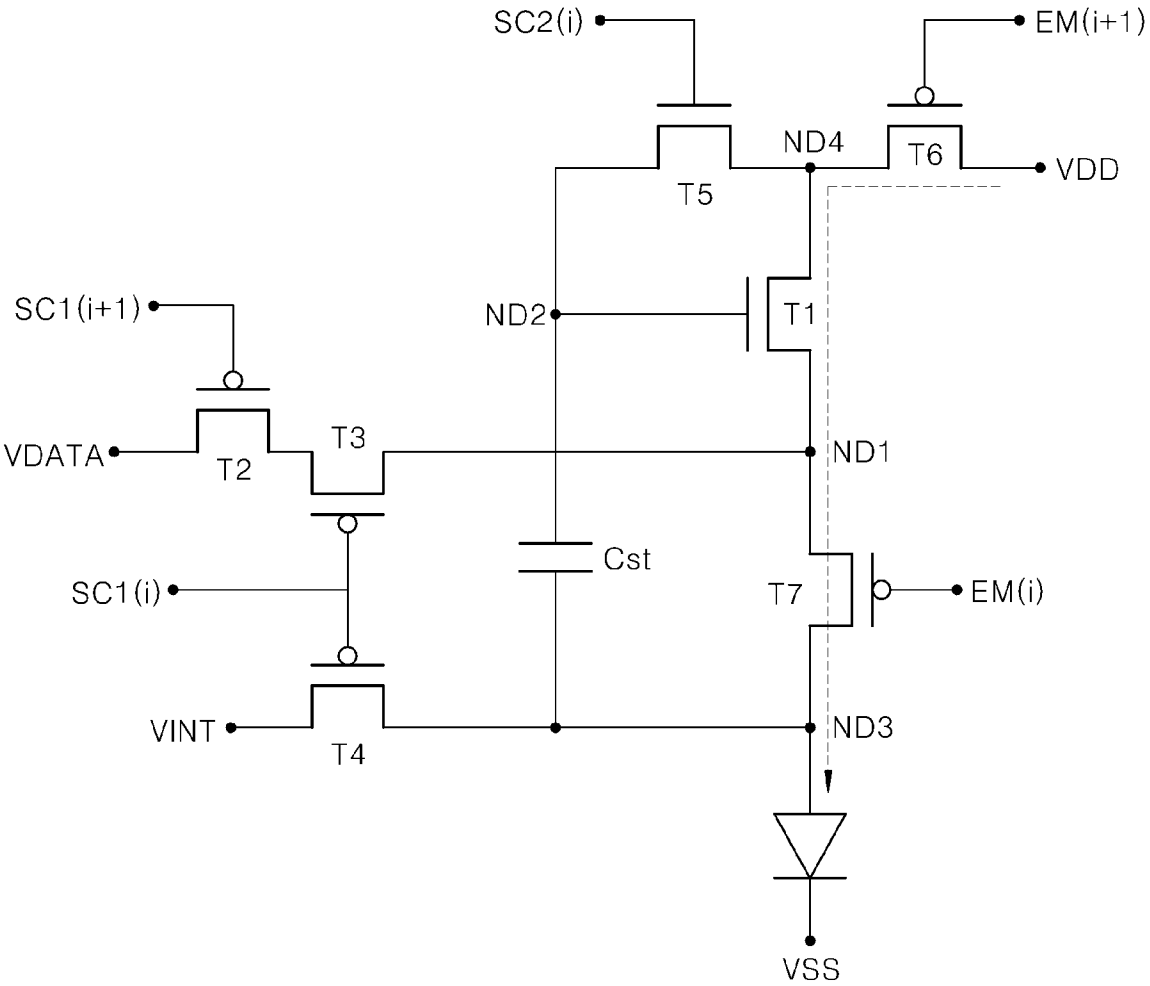
Figure 7:
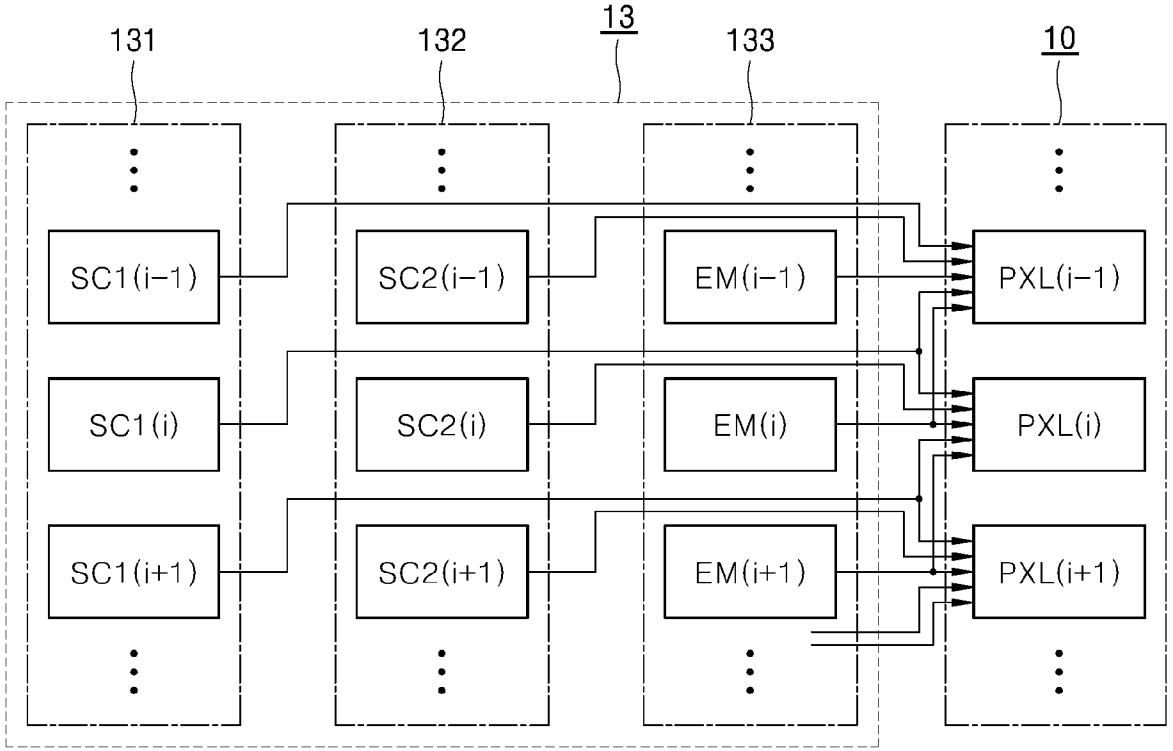
FIG. 7 is a diagram illustrating the gate drive unit of FIG. 1 according to an aspect of the present disclosure.

FIG. 1 is a diagram illustrating an organic light emitting display device according to an aspect of the present disclosure. FIG. 2 is a diagram showing an equivalent circuit corresponding to one pixel in the organic light emitting display device according to an aspect of the present disclosure. FIG. 3 shows waveforms of the drive control signals of FIG. 2. FIG. 4 is a diagram illustrating the gate drive unit of FIG. 1 according to an aspect of the present disclosure. FIG. 5, FIG. 6, and FIG. 7 are diagrams showing current directions in the equivalent circuit corresponding to the pixel during an initial period, an addressing period, and an emission period in FIG. 3.

As shown in FIG. 1, the organic light emitting display device according to an aspect of the present disclosure includes a display panel 10 having a plurality of pixels PXL, a data driving circuit 12 for driving a data line 14 of the display panel 10, a gate driving circuit 13 for driving a scan line 15 of the display panel 10, and a timing controller 11 for controlling drive timings of the data driving circuit 12 and gate driving circuit 13.

The display panel 10 includes scan lines 15 and data lines 14 which intersect each other. Since a plurality of pixel areas corresponding to a plurality of pixels PXL are defined as the intersection between the scan line 15 and the data line 14, the pixel areas are arranged in a matrix form in a display area.

The scan line 15 of the display panel 10 includes a first scan line for supplying a switching scan signal SC1 and a second scan line for supplying a sampling scan signal SC2.

And, the display panel 10 further includes an emission line for supplying an emission signal EM corresponding to the respective horizontal lines of the pixels PXL, a first driving source line for supplying a first driving source VDD, a second driving source line for supplying a second driving source VSS lower than the first driving source VDD, and an initialization source line for supplying an initialization source VINT. Here, the initialization source VINT is set to a potential lower than an operation initiation voltage of the organic light emitting device.

The timing controller 11 rearranges the digital video data RGB received from outside according to a resolution of the display panel 10, and supplies the rearranged digital video data RGB' to the data driving circuit 12.

And, the timing controller 11 supplies a data control signal DDC for controlling the operation timing of the data driving circuit 12 and a gate control signal GDC for controlling the operation timing of the gate driving circuit 13 based on various timing signals such as a vertical synchronous signal Vsync, a horizontal synchronous signal Hsync, a dot clock signal DCLK, a data enable signal DE, etc.

The data driving circuit 12 converts the rearranged digital video data RGB' to an analog data voltage based on the data control signal DDC. And, the data driving circuit 12 supplies a data signal VDATA to the pixels of the respective vertical lines during respective horizontal periods based on the rearranged digital video data RGB'.

The gate driving circuit 13 can generate the switching scan signal SC1, the sampling scan signal SC2, and the emission signal EM corresponding to the respective horizontal lines based on the gate control signal GDC. The gate driving circuit 13 can include a first scan driving block (131 in FIG. 7) for supplying the switching scan signal SC1 for the respective horizontal lines, a second scan driving block (132 in FIG. 7) for supplying the sampling scan signal SC2 for the respective horizontal lines, and an emission driving block for supplying the emission signal EM for the respective horizontal lines.

This gate driving circuit 13 can be disposed in a non-display area of the display panel 10 according to a gate-driver in panel (GIP) method.

The pixel shown in FIG. 2 is one of the pixels of the plurality of pixels which are arranged in the $i^{th}$ horizontal line. Here, i is a natural number greater than 3 and smaller than N, and N is the number of all horizontal lines included in the display panel (10 in FIG. 1).

As shown in FIG. 2, in the organic light emitting display device according to an aspect of the present disclosure, each of the pixels PXL includes an organic light emitting device OLED, first to seventh thin film transistors T1, T2, T3, T4, T5, T6, T7 and a storage capacitor Cst.

In the respective pixels PXL, the first, second, and third thin film transistors and the storage capacitor implement a pixel driving circuit for supplying a drive current to the organic light emitting device OLED during the respective image frames, and the rest fourth to seventh thin film transistors T4-T7 implement a compensation circuit for compensating for the threshold voltage of the first thin film transistor T1.

And, some of the first, second, third, fourth, fifth, sixth, and seventh thin film transistors T1, T2, T3, T4, T5, T6, and T7 have a structuring including an active layer made of a low-temperature polycrystalline semiconductor (LTPS) material while the rest have a structure including an active layer made of an oxide semiconductor material.

For example, the first thin film transistor T1 is an element for generating the drive current to be supplied to the organic light emitting device OLED. Therefore, the first thin film transistor T1 can be formed in a structure including the active layer made of the oxide semiconductor material whose variation in the threshold voltage due to the brightness of previous image frames is relatively small. By doing so, an afterimage due to the variation in the threshold voltage of the first thin film transistor T1 can be suppressed.

And, the fifth thin film transistor T5 for compensating for the threshold voltage of the first thin film transistor T1 can have a structure including an active layer made of the oxide semiconductor material which incurs a small leakage current. By doing so, a variation in the brightness due to the leakage current of the fifth thin film transistor T5 during one image frame can be decreased. Therefore, a flicker phenomenon, in which an image frame shift can be observed when the display device is driven at a low speed, due to the variation in the brightness of respective image frames can be prevented.

In addition, the thin film transistor including the active layer made of the LTPS material and the thin film transistor including the active layer made of the oxide semiconductor material can be made in metal oxide semiconductor (MOS) structures with different conduction types.

In this case, in order to simplify processes, the thin film transistors including active layers made of the LTPS can be implemented as PMOS transistors, while the thin film transistor including the active layer made of the oxide semiconductor material can be implemented as an NMOS transistor.

The organic light emitting device OLED includes an anode electrode and a cathode electrode, as well as an organic light emitting layer (not shown) disposed between the anode and cathode electrodes. For example, the organic light emitting layer includes a hole injection layer, a hole transport layer, a light emitting layer, and an electron transport layer. Alternatively, the organic light emitting display device can further include an electron injection layer.

The first thin film transistor T1 is connected in series with the organic light emitting device OLED between a first driving source line supplying a first driving source VDD and a second driving source line supplying a second driving source VSS which is lower than the first driving source VDD.

A gate electrode of the first thin film transistor T1 is connected with the storage capacitor Cst via a second node ND2. One of the first and second electrodes (source electrode and the drain electrode) is connected with a fourth node ND4 corresponding to the first driving source VDD, while the other is connected with a first node ND1 corresponding to the organic light emitting device OLED.

When the first thin film transistor T1 is turned on based on a turn-on signal supplied from the storage capacitor Cst, the drive current for the organic light emitting device OLED is supplied.

The second and third thin film transistors T2, T3 are connected in series with each other between the first node ND1, between the first thin film transistor T1 and the organic light emitting device OLED, and a data line supplying a data signal VDATA.

More particularly, the second thin film transistor T2 is disposed between the data line and the third thin film transistor T3, while the third thin film transistor T3 is disposed between the second thin film transistor T2 and the first node ND1.

One of the second and third thin film transistors T2, T3 (third thin film transistor T3 in FIG. 2) is turned on based on the $i^{th}$ switching scan signal SC1($i$) (i is a natural number greater than or equal to 1 and smaller than or equal to N, where N is the number of horizontal lines), while the other (second thin film transistor T2 in FIG. 2) is turned on based on an $(i+1)^{th}$ switching scan signal SC1($i$+1).

For example, the third thin film transistor T3 is turned on based on the $i^{th}$ switching scan signal SC1($i$) corresponding to the $i^{th}$ horizontal line, while the second thin film transistor T2 is turned on based on the $(i+1)^{th}$ switching scan signal SC1($i$+1) corresponding to an $(i+1)^{th}$ horizontal line which follows the $i^{th}$ horizontal line.

When all of the second and third thin film transistors T2, T3 are turned on, the data signal VDATA is supplied to the first node ND1.

The storage capacitor Cst is disposed between the second node ND2, which is connected with the gate electrode of the first thin film transistor T1, and the third node ND3 which is connected with the anode electrode of the organic light emitting device OLED.

The fourth thin film transistor T4 is connected between an initialization source line supplying an initialization source VINT and the third node ND3. As in the case for one of the second and third thin film transistors T2, T3, the fourth thin film transistor T4 is turned on based on the $i^{th}$ switching scan signal SC1($i$) corresponding to the $i^{th}$ horizontal line.

That is, the drive control signals, which correspond to one of the second and third thin film transistors T2, T3 and the fourth thin film transistor T4, are shared as the $i^{th}$ switching scan signal SC1($i$).

When the fourth thin film transistor T4 is turned on based on the $i^{th}$ switching scan signal SC1($i$), it supplies the initialization source VINT to the third node ND3.

The fifth thin film transistor T5 is connected between the fourth node ND4 and the second node ND2. Here, the second node ND2 is connected with the gate electrode of the first thin film transistor T1, while the fourth node ND4 is connected with one of the first and second electrodes of the first thin film transistor T1 which corresponds to the first driving source VDD. Therefore, the fifth thin film transistor T5 is provided to compensate for the threshold voltage of the first thin film transistor T1.

The fifth thin film transistor T5 is turned on based on the $i^{th}$ sampling scan signal SC2($i$).

In addition, the fifth thin film transistor T5 is turned on during the same period as the third and fourth thin film transistors T3, T4. On the other hand, since the fifth thin film transistor T5 is made in an MOS structure with a conduction type different from that of the third and fourth thin film transistors T3, T4, the drive control signal corresponding to the fifth thin film transistor T5 should be supplied separately from the drive control signal corresponding to the third and fourth thin film transistors T3, T4 (That is, $i^{th}$ switching scan signal SC1($i$)). Therefore, the drive control signal corresponding to the fifth thin film transistor T5 is provided as the $i^{th}$ sampling scan signal SC2($i$) separately from the $i^{th}$ switching scan signal SC1($i$).

The sixth thin film transistor T6 is connected between the first driving source line supplying the first driving source VDD and the fourth node ND4. When the sixth thin film transistor T6 is turned on based on the $(i+1)^{th}$ emission signal EM(i+1) corresponding to the $(i+1)^{th}$ horizontal line, it supplies the first driving source VDD to the fourth node ND4.

The seventh thin film transistor T7 is connected between the first node ND1 and the third node ND3. When the seventh thin film transistor T7 is turned on based on the $i^{th}$ emission signal EM(i) corresponding to the $i^{th}$ horizontal line, it generates a current path where the drive current is supplied to the organic light emitting device OLED by the first thin film transistor T1.

As shown in FIG. 3 and FIG. 4, the $i^{th}$ switching scan signal SC1($i$), the $i^{th}$ sampling scan signal SC2($i$), and the $(i+1)^{th}$ emission signal EM(i+1) can be supplied at respective turn-on levels during an initial period Initial of the respective image frames. For example, the turn-on levels of the switching scan signal SC1 and the emission signal EM can be a low level corresponding to a PMOS transistor, while the turn-on level of the sampling scan signal SC2 can be a high level corresponding to an NMOS transistor.

In the meantime, the third and fourth thin film transistors T3, T4 are turned on based on the ith switching scan signal SC1(*i*). By doing so, the initialization source VINT is supplied to the third node ND3 through the fourth thin film transistor T4 which is turned on.

And, a differential voltage (VDD−Vth) between the first driving source VDD and the threshold voltage (Vth) of the first thin film transistor T1 is supplied to the second node ND2 via the fifth thin film transistor T5, which is turned on by the $i^{th}$ sampling scan signal SC2(*i*), and the sixth thin film transistor T6 which is turned on by the $(i+1)^{th}$ emission signal EM(i+1).

And, since the fifth thin film transistor T5 is turned on, a potential of the gate electrode of the first thin film transistor T1 comes to be close to the threshold voltage (Vth), which causes the first thin film transistor T1 to be turned on.

Then, as shown in FIG. 3 and FIG. 5, during the addressing period Addressing of the respective image frames, the $(i+1)^{th}$ emission signal EM(i+1 is supplied at the turn-off level, the $i^{th}$ switching scan signal SC1(*i*) and the $i^{th}$ sampling scan signal SC2(*i*) are maintained at the turn-on levels, and the $(i+1)^{th}$ switching scan signal SC1(*i*+1) is supplied at the turn-on level.

In the meantime, the initialization source VINT is continuously supplied to the third node ND3 via the fourth thin film transistor T4 which is maintained at the turn-on state.

And, the data signal VDATA is supplied to the first node ND1 via the second and third thin film transistors T2, T3 which are turned on by the ith switching scan signal SC1(*i*) and the $(i+1)^{th}$ switching scan signal SC1(*i*+1) at the turn-on level.

Also, the sixth thin film transistor T6 is turned off, while the fifth thin film transistor T5 and the first thin film transistor T1 are turned on. As a result, a differential voltage (VDATA−Vth) between the data signal VDATA and the threshold voltage (Vth) of the first thin film transistor T1 is supplied to the second node ND2 via a current path including the first and fifth thin film transistors T1, T5.

Therefore, the potential of the second node ND2 is decreased from the voltage VDD−Vth during the initial period Initial by the voltage (VDATA−Vth) which is supplied during the addressing period Addressing.

And, the storage capacitor Cst is charged by the differential voltage (VDD−VDATA) between the second node ND2 and the third node ND3.

Then, as shown in FIG. 3 and FIG. 6, the during the emission period Emission of the respective image frames, the $i^{th}$ switching scan signal SC1(*i*), the $(i+1)^{th}$ switching scan signal SC1(*i*+1), and the $i^{th}$ sampling scan signal SC2(*i*) are supplied at the turn-off levels, while the ith emission signal EM(i) and the $(i+1)^{th}$ emission signal EM(i+1) are supplied at the turn-on levels.

In the meantime, the drive current is supplied to the organic light emitting device OLED via the current path including the sixth thin film transistor T6, the first thin film transistor T1, and the seventh thin film transistors T7 which are turned on. In the meantime, the amount of the drive current corresponds to the data signal VDATA.

As explained in the above, according to an aspect of the present disclosure, in the respective pixels, the series-connected second and third thin film transistors T2, T3 are disposed between the data line for supplying the data signal VDATA and the first thin film transistor T1.

The drive control signal corresponding to one of the second and third thin film transistors T2, T3 (third thin film transistor T3) can be selected as the $i^{th}$ switching scan signal SC1(*i*) corresponding to the fourth thin film transistor T4 which is turned on during the initial period Initial and the addressing period Addressing.

And, according to an aspect of the present disclosure, the respective image frames can further include a holding period Holding between the addressing period Addressing and the emission period Emission.

Therefore, the drive control signal for turning on the other of the second and third thin film transistors T2, T3 (second thin film transistor T2) during the addressing period Addressing can be selected as the $(i+1)^{th}$ switching scan signal SC1(*i*+1) which has the same pulse-width as the $i^{th}$ switching scan signal SC1(*i*).

As a result, the drive control signal corresponding to the other (second thin film transistor T2) of the second and third thin film transistors T2, T3 which is turned on only during the addressing period Addressing in the respective image frames does not have be supplied separately to the respective pixels.

And, thanks to the holding period Holding, the drive control signal corresponding to the sixth thin film transistor T6, which is changed to the turn-off level during the addressing period Addressing, can be selected as the $(i+1)^{th}$ emission signal EM(i+1) which has the same pulse-width as the $i^{th}$ emission signal EM(i). As a result, the drive control signal corresponding to the sixth thin film transistor T6 which is turned off only during the addressing period Addressing in the respective image frames does not have be supplied separately.

Therefore, according to an aspect of the present disclosure, the number of the drive control signals, which need to be generated by different blocks, can be decreased to three, which results in further simplification of the structure of the gate drive unit.

That is, as shown in FIG. 7, the gate drive unit 13 includes a first scan driving block 131 for supplying the switching scan signal SC1 for the respective horizontal lines, a second scan driving block 132 for supplying the sampling scan signal SC2 for the respective horizontal lines, and an emission driving block for supplying the emission signal EM for the respective horizontal lines.

In the meantime, the $(i+1)^{th}$ switching scan signal SC1 (*i*+1) corresponding to the i+1th horizontal line is supplied to the pixels PXL(i) in the $i^{th}$ horizontal line and the pixels PXL(i+1) in the $(i+1)^{th}$ horizontal line.

In the same manner, the $(i+1)^{th}$ emission signal EM(i+1) corresponding to the $(i+1)^{th}$ horizontal line is supplied to the pixels PXL(i) in the $i^{th}$ horizontal line and the pixels PXL (i+1) in the $(i+1)^{th}$ horizontal line.

As mentioned in the above, the drive control signal corresponding to the other (second thin film transistor T2) of the second and third thin film transistors T2, T3 in the respective pixels PXL which is turned on only during the addressing period Addressing is selected as the $(i+1)^{th}$ switching scan signal SC1(*i*+1) corresponding to the $(i+1)^{th}$ horizontal line. And, the drive control signal corresponding to the sixth thin film transistor T6 which is turned off only during the addressing period Addressing is selected as the $(i+1)^{th}$ emission signal EM(i+1) corresponding to the $(i+1)^{th}$ horizontal line. Therefore, the gate drive unit 13 does not need separate blocks for supplying the drive control signal corresponding to the other (second thin film transistor T2) of the second and third thin film transistors T2, T3 which is turned on only during the addressing period Addressing and the drive control signal corresponding to the sixth thin film transistor T6. As a result, the structure of the gate drive unit 13 can be simplified. Therefore, the area allocated for the gate drive unit 13 is reduced, which prevents the width a bezel due to the gate drive unit 13 embedded in the display panel 10 from being increased.

The present disclosure as explained in the above is not limited to the described aspects and appended figures, and it will be apparent to the ordinary person in the related art that various substitutions, modification, and variations can be made without departing from the technical spirit of the present disclosure.

What is claimed is:

1. An organic light emitting display device comprising a plurality of pixels, wherein each of the plurality of pixels comprises:

an organic light emitting diode;

a first thin film transistor connected in series with the organic light emitting diode between a first driving source line supplying a first driving source and a second driving source line supplying a second driving source lower than the first driving source; and second and third thin film transistors connected in series with each other between a first node and a data line supplying a data signal, wherein the first node is disposed between the first thin film transistor and the organic light emitting diode, and wherein the data signal is supplied to the first node when the second and third thin film transistors are turned on.

2. The organic light emitting display device of claim 1, wherein the second thin film transistor is disposed between the data line and the third thin film transistor, wherein the third thin film transistor is disposed between the second thin film transistor and the first node, and wherein one of the second and third thin film transistors is turned on based on an $i^{th}$ switching scan signal (where i is a natural number greater than or equal to 1 and smaller than or equal to N, and N is the number of horizontal lines) while the other is turned on based on an $(i+1)^{th}$ switching scan signal.

3. The organic light emitting display device of claim 2, further comprising:

a storage capacitor disposed between a second node connected with a gate electrode of the first thin film transistor and a third node connected with an anode electrode of the organic light emitting diode; and a fourth thin film transistor connected between an initialization source line supplying an initialization source and the third node, wherein the fourth thin film transistor is turned on based on the $i^{th}$ switching scan signal.

4. The organic light emitting display device of claim 3, further comprising:

a fifth thin film transistor connected between a fourth node and the second node, wherein the fourth node is disposed between the first thin film transistor and the first driving source line, and the fifth thin film transistor is turned on based on an $i^{th}$ sampling scan signal.

5. The organic light emitting display device of claim 4, further comprising:

a sixth thin film transistor connected between the first driving source line and the fourth node and is turned on based on an $(i+1)^{th}$ emission signal; and a seventh thin film transistor connected between the first node and the third node and is turned on based on an $i^{th}$ emission signal.

6. The organic light emitting display device of claim 5, wherein the first and fifth thin film transistors include an active layer made of an oxide semiconductor material while the second, third, fourth, sixth and seventh thin film transistors include an active layer made of a polysilicon semiconductor material.

7. The organic light emitting display device of claim 6, wherein the thin film transistors including the active layer made of the oxide semiconductor material and the thin film transistors including the active layer made of the polysilicon semiconductor material have metal oxide semiconductor (MOS) structures with different conduction types.

8. A method of the driving an organic light emitting display device comprising a plurality of pixels, the method comprising:

supplying an initialization source to a third node during a first period by turning on a fourth thin film transistor, and supplying a first driving source to a second node by turning on fifth and sixth thin film transistors;

supplying a data signal to a first node during a second period by turning on second and third thin film transistors; and supplying a drive current to an organic light emitting diode during a third period by turning on the sixth thin film transistor and first and seventh thin film transistors, wherein each of the plurality of pixels comprises:

the organic light emitting diode;

the first thin film transistor connected in series with the organic light emitting diode between a first driving source line supplying the first driving source and a second driving source line supplying a second driving source lower than the first driving source;

the second and third thin film transistors connected in series with each other between the first node and a data line supplying a data signal, the first node disposed between the first thin film transistor and the organic light emitting diode;

the fourth thin film transistor connected between an initialization source line supplying an initialization source and the third node;

the fifth thin film transistor connected between a fourth node between the first thin film transistor and the first driving source line and the second node;

the sixth thin film transistor connected between the first driving source line and the fourth node; and the seventh thin film transistor connected between the first node and the third node, wherein the data signal is supplied to the first node when the second and third thin film transistors are turned on.

9. The method of the driving an organic light emitting display device of claim 8, wherein one of the second and third thin film transistors is turned on based on an ith switching scan signal (where i is a natural number greater than or equal to 1 and smaller than or equal to N, and N is the number of horizontal lines) while the other is turned on based on an $(i+1)^{th}$ switching scan signal, and wherein the fourth thin film transistor is turned on based on the $i^{th}$ switching scan signal.

10. The method of the driving an organic light emitting display device of claim 9, wherein one of the second and third thin film transistors is turned on along with the fourth thin film transistor during the first and second periods based on the $i^{th}$ switching scan signal, while the other is turned on during the second period based on the $(i+1)^{th}$ switching scan signal.

11. The method of the driving an organic light emitting display device of claim 9, wherein the fifth thin film transistor has a conduction type different from that of the fourth thin film transistor, and wherein the fifth thin film transistor is turned on during the first and second periods based on an $i^{th}$ sampling scan signal.

12. The method of the driving an organic light emitting display device of claim 9, wherein the sixth thin film transistor is turned on during the first and third periods based on an $(i+1)^{th}$ emission signal, and wherein the seventh thin film transistor is turned on during the third period based on an $i^{th}$ emission signal.

13. The method of the driving an organic light emitting display device of claim 8, wherein the first and fifth thin film transistors include an active layer made of an oxide semiconductor material and the second, third, fourth, sixth and seventh thin film transistors include an active layer made of a polysilicon semiconductor material.

14. The method of the driving an organic light emitting display device of claim 13, wherein the thin film transistors including the active layer made of the oxide semiconductor material and the thin film transistors including the active layer made of the polysilicon semiconductor material have metal oxide semiconductor (MOS) structures with different conduction types.

15. An organic light emitting display device comprising a plurality of pixels, wherein each of the plurality of pixels comprises:

an organic light emitting diode;

a first thin film transistor connected in series with the organic light emitting diode between a first driving source line supplying a first driving source and a second driving source line supplying a second driving source lower than the first driving source;

second and third thin film transistors connected in series with each other between a first node and a data line supplying a data signal, wherein the first node is disposed between the first thin film transistor and the organic light emitting diode, the second thin film transistor is disposed between the data line and the third thin film transistor, and the third thin film transistor is disposed between the second thin film transistor and the first node;

a storage capacitor disposed between a second node connected with a gate electrode of the first thin film transistor and a third node connected with an anode electrode of the organic light emitting diode; and a fourth thin film transistor connected between an initialization source line supplying an initialization source and the third node, wherein the fourth thin film transistor is turned on based on the $i^{th}$ switching scan signal, wherein the data signal is supplied to the first node when the second and third thin film transistors are turned on, and wherein one of the second and third thin film transistors is turned on based on an $i^{th}$ switching scan signal (where i is a natural number greater than or equal to 1 and smaller than or equal to N, and N is the number of horizontal lines) while the other is turned on based on an $(i+1)^{th}$ switching scan signal.

16. The organic light emitting display device of claim 15, further comprising:

a fifth thin film transistor connected between a fourth node and the second node, wherein the fourth node is disposed between the first thin film transistor and the first driving source line, and the fifth thin film transistor is turned on based on an $i^{th}$ sampling scan signal.

17. The organic light emitting display device of claim 16, further comprising:

a sixth thin film transistor connected between the first driving source line and the fourth node and is turned on based on an $(i+1)^{th}$ emission signal; and a seventh thin film transistor connected between the first node and the third node and is turned on based on an $i^{th}$ emission signal.

18. The organic light emitting display device of claim 17, wherein the first and fifth thin film transistors include an active layer made of an oxide semiconductor material while the second, third, fourth, sixth and seventh thin film transistors include an active layer made of a polysilicon semiconductor material.

19. The organic light emitting display device of claim 18, wherein the thin film transistors including the active layer made of the oxide semiconductor material and the thin film transistors including the active layer made of the polysilicon semiconductor material have metal oxide semiconductor (MOS) structures with different conduction types.

* * * * *